United States Patent [19]

Yonkers

[11] 3,956,856

[45] May 18, 1976

[54] RECIPROCATING SHARPENER

[76] Inventor: Edward H. Yonkers, 905 Westerfield Drive, Wilmette, Ill. 60091

[22] Filed: Feb. 18, 1975

[21] Appl. No.: 550,663

Related U.S. Application Data

[63] Continuation-in-part of Ser. No. 549,963, Feb. 14, 1975.

[52] U.S. Cl. ..... 51/59 R; 51/170 TL

[51] Int. Cl.[2] ..... B24B 3/54

[58] Field of Search..... 51/57, 58, 59 R, 170 TL

[56] References Cited

UNITED STATES PATENTS

| | | | |
|---|---|---|---|
| 1,524,902 | 2/1925 | Anderson | 51/59 R X |
| 2,024,860 | 12/1935 | Hobart | 51/58 |
| 2,106,977 | 2/1938 | Hobart | 51/58 |
| 2,435,565 | 2/1948 | Bautz | 51/58 |

*Primary Examiner*—Harold D. Whitehead
*Attorney, Agent, or Firm*—Mason, Kolehmainen, Rathburn & Wyss

[57] ABSTRACT

A reciprocating sharpener includes a plastic or metal housing mounted on a rigid base. Each of four, thin, flat, rectangular steel springs has one of its edges fixedly secured to the base. The opposite edge or free end of each of the steel springs is fixedly secured to one end of one of two elongated armatures or carriage members that are mounted in the sharpener in a parallel, coplanar condition. The armatures include upper, unobstructed surfaces with abrasive material of the type used for grinding or sharpening metal affixed thereto. Each armature further includes a laminated, iron, armature core fixedly mounted thereto. A laminated, iron, stator core and field coil are fixedly mounted on the base. The two armature cores are physically spaced on opposite sides of the stator core to cause the armature cores to move toward the stator core and each other upon the energization of the field coil by periodic pulses of electric current. Thus, the armatures or bridge members move in opposite directions upon the energization of the field coil and deflect their associated steel springs. When the field coil is deenergized, the steel springs reverse the directions of movement of the armatures and of the two armature cores causing the armature cores to move away from the stator core and from each other. The natural frequency of vibration of the armature-spring-base configurations is made approximately equal to the frequency of the periodic electric current supplied to the field coil, causing the armatures to reciprocate in opposite directions of 180° out of phase. When a workpiece, such as an edge of a knife blade, is placed in contact with the abrasive material affixed to the open surfaces of the bridge members, the workpiece is maintained relatively stationary by the oppositely directed motions of the two bridge members and may be easily and rapidly sharpened or ground to the desired angle and degree of sharpness.

40 Claims, 6 Drawing Figures

Fig. 1
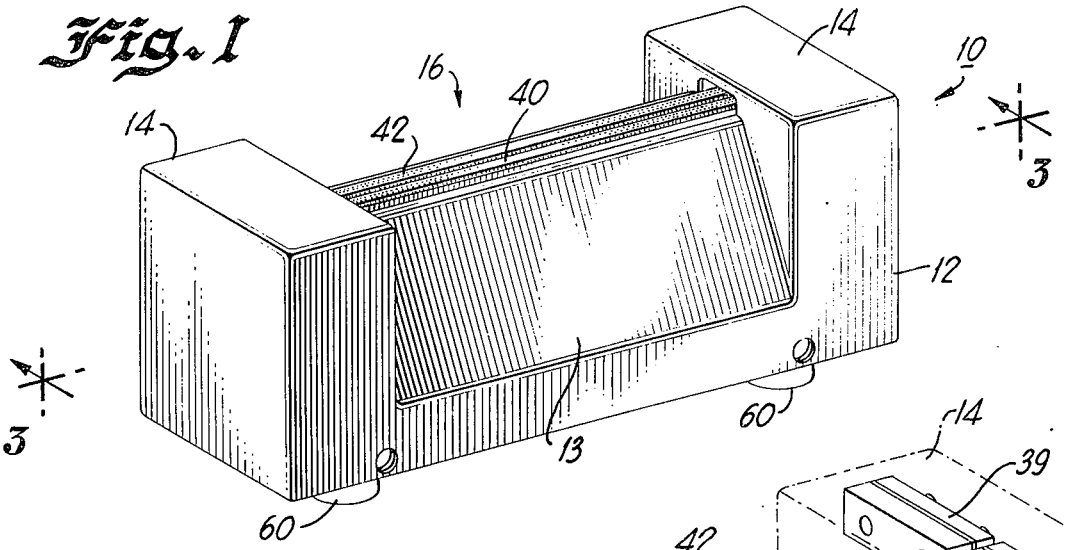
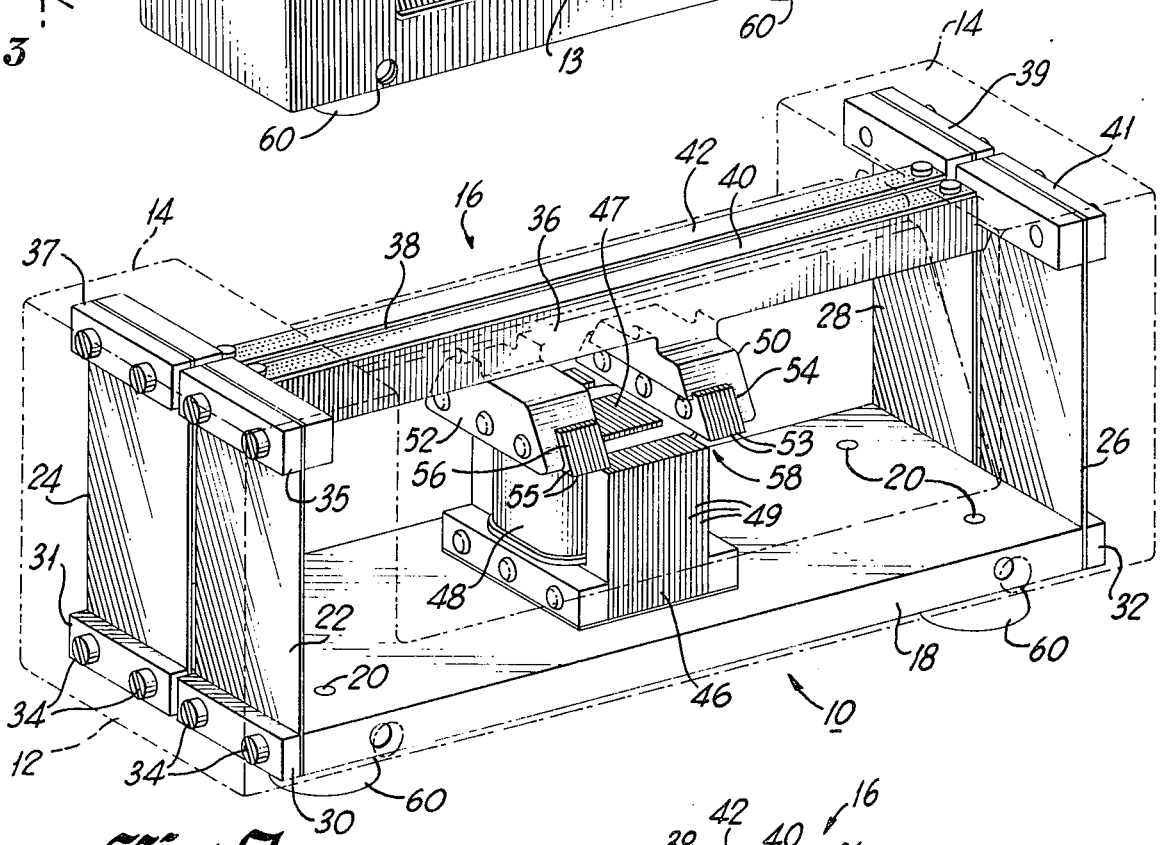
Fig. 2
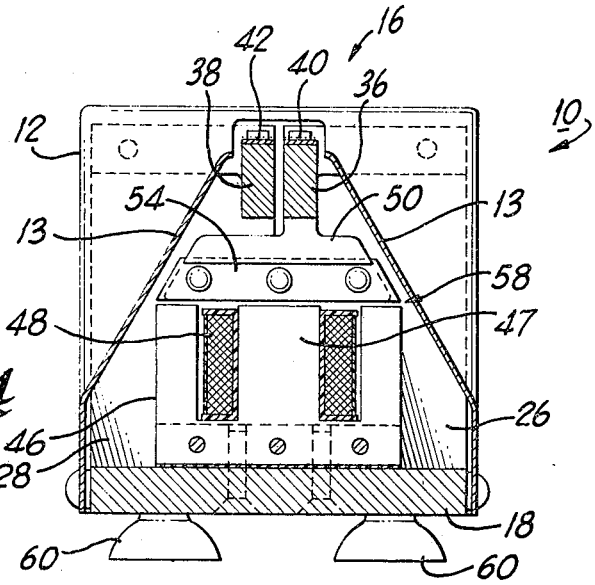
Fig. 4

Fig. 3
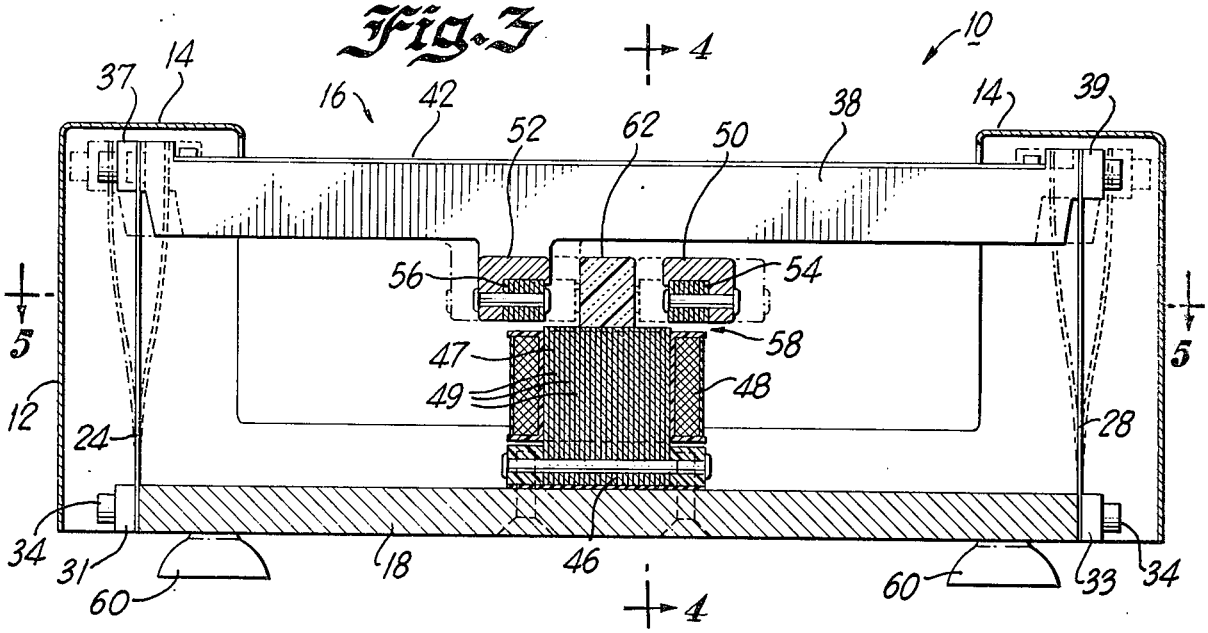
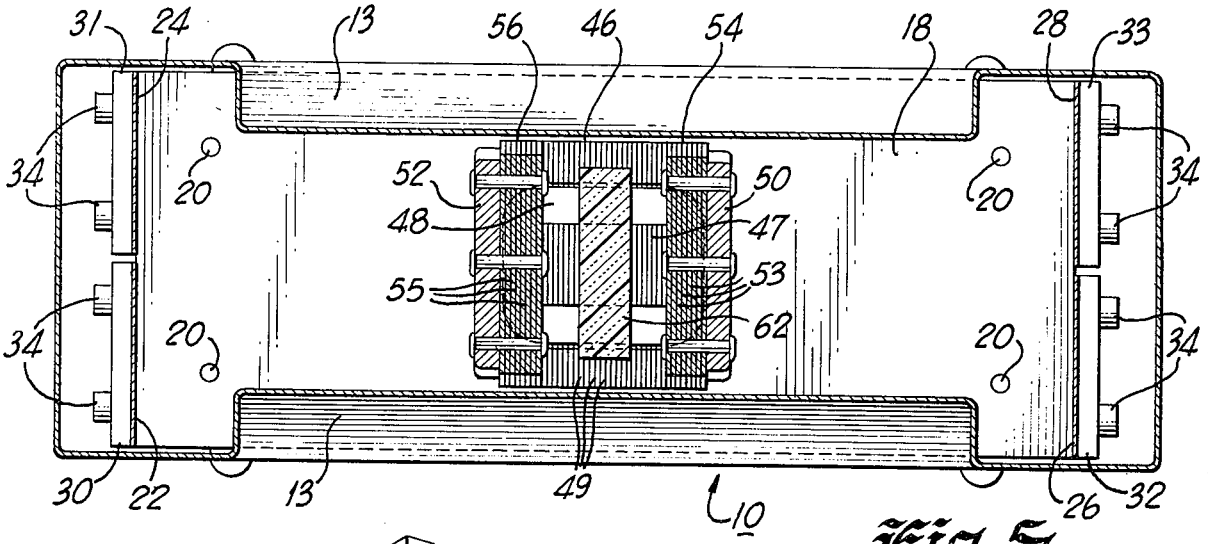
Fig. 5
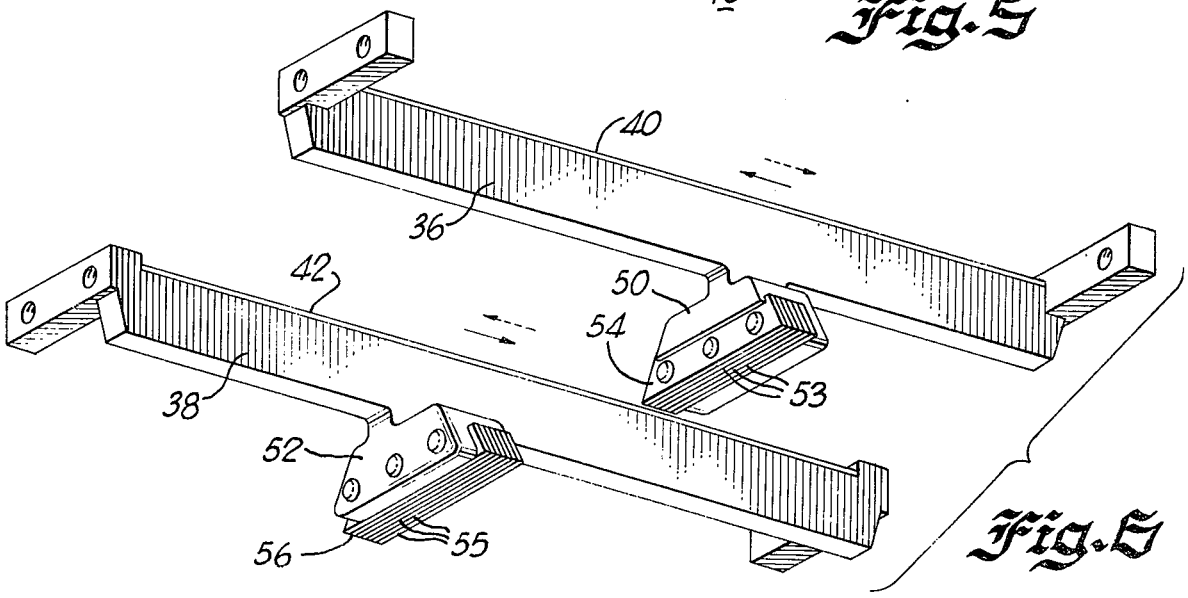
Fig. 6

RECIPROCATING SHARPENER

CROSS-REFERENCE TO RELATED APPLICATIONS

This application is a continuation-in-part application of a prior-filed, copending application Ser. No. 549,963 by Edward H. Yonkers, entitled "RECIPROCATING MOTOR" and filed on Feb. 14, 1975, which is hereby incorporated herein by reference for all purposes.

BACKGROUND OF THE INVENTION

A. Field of the Invention

The device of the present invention generally relates to a new and improved apparatus for sharpening or grinding a workpiece and, more particularly, to a new and improved apparatus for sharpening fine cutlery or the like.

B. Description of the Prior Art

Conventional household knife sharpeners generally employ one or more rotating, circular, abrasive stones having angular or conical edges. The housings of the sharpeners typically include guide slots for positioning a knife blade against or between the rotating stones. Such devices are normally not adjustable to handle the variations in blade angle, thickness and curvature present in fine cutlery. Thus, fine cutlery may be severely damaged upon being sharpened by such devices. The problem of control of the blade edge angle is quite significant due to the normally visually hidden interface between the blade edge and the stone preventing proper positioning during the sharpening process.

SUMMARY OF THE INVENTION

An object of the present invention is the provision of a new and improved grinding or sharpening device.

Another object of the present invention is the provision of a new and improved grinding or sharpening device having a pair of long, narrow, reciprocating, oppositely directed, unobstructed, planar grinding surfaces for easily and rapidly grinding or sharpening a workpiece, such as a knife blade.

A further object of the present invention is the provision of a new and improved grinding or sharpening device that does not employ bearings or other surface engaging members that are subject to contamination and wear from grit and metal particles encountered in grinding operations and that maintains a workpiece, such as a knife blade, relatively stationary during a grinding or sharpening operation.

Briefly, the device of the present invention is a new and improved knife sharpener for rapidly and facilely sharpening knives, especially fine cutlery. The knife sharpener includes a plastic or metal housing that is open at the top and is mounted on a rigid base.

In accordance with an important feature of the present invention, one of two longitudinal extremities of each of four, thin, rectangular flat steel springs are fixedly secured to the rigid rectangular base. The other or free end of each of the four steel springs is fixedly secured to one of two elongated armatures or bridge members that are mounted for movement in the sharpening device above the base member in elongated, parallel, substantially coplanar, reciprocative paths, substantially parallel to the plane of the rigid base. The armatures or bridge members including upper, long narrow unobstructed flat surfaces carrying abrasive material of the type used for grinding or sharpening metal affixed thereto and exposed at the top of the sharpener. In a preferred embodiment, the abrasive material is formed of a tungsten carbide grit. The opening at the top of the housing is sufficiently unobstructed to enable an operator to freely control the angle of a blade edge during the sharpening operation. Each armature includes a laminated armature core fixedly mounted thereto. A laminated stator core and field coil are fixedly mounted to the base. The two armature cores are physically spaced on opposite sides of the stator core to cause the armature cores to move towards the stator core and each other upon energization of the field coil by periodic electric current. Thus, upon energization of the field coil the armatures move in opposite directions along the direction of reciprocation determined by the single degree of freedom permitted by the rectangular parallelepiped configuration of the spring-armature-base systems. Furthermore, this unique parallelepiped configuration permits the workpiece to be pressed against the reciprocating abrasive surfaces with high forces without introducing friction losses other than the work actually performed by the abrasives on the workpiece. When a workpiece, such as a knife blade edge is placed in contact with the abrasive material affixed to the upper surfaces of the armatures or bridge members, the workpiece is maintained relatively stationary by the oppositely directed motions of the two bridge members and thus may be easily and rapidly sharpened or ground to a desired angle or degree of sharpness. In addition, the vibrations transmitted to the base by the movement of each of the armatures are cancelled by the vibrations of opposite phase transmitted to the rigid base by the movement of the other armature or bridge member.

BRIEF DESCRIPTION OF THE DRAWINGS

To the accomplishment of the foregoing and related ends, the invention then comprises the features hereinafter fully described and particularly pointed out in the claims, the following description and the annexed drawings setting forth in detail a certain illustrative embodiment of the invention, this being indicative, however, of but one of the various ways in which the principle of the invention may be employed.

In said annexed drawings:

FIG. 1 is a perspective view of a preferred embodiment of a reciprocating sharpener constructed in accordance with the principles of the present invention;

FIG. 2 is an enlarged, perspective view showing the interior of the present invention illustrated in FIG. 1;

FIG. 3 is an enlarged, cross-sectional, elevational view of the present invention taken along line 3—3 of FIG. 1;

FIG. 4 is a cross-sectional view of the device of the present invention taken along line 4—4 of FIG. 3;

FIG. 5 is a cross-sectional view of the device of the present invention taken along line 5—5 of FIG. 3; and FIG. 6 is an enlarged, exploded view of the work armatures of the present invention illustrated in FIG. 1.

DESCRIPTION OF THE PREFERRED EMBODIMENT

With reference to FIGS. 1 through 3 of the drawings, there is illustrated a new and improved reciprocating sharpener 10 constructed in accordance with the principles of the present invention. The sharpener 10 may be used in the home upon being connected to an alternating current supply typically available in a wall outlet and thereafter operated to sharpen knives and the like.

The sharpener includes a metal or plastic housing 12 having an overlapping top edge portion 14 configured such that there is a large, unobstructed opening 16 at the upper portion of the housing 12. Moreover, housing 12 includes sloping sides 13 (FIG. 1) having a configuration that also lends to the unobstructed nature of opening 16. In the particular device illustrated, sharpener 10 also includes a rigid base 18 (FIG. 2) secured to the bottom of the housing 12 by fasteners 20.

In accordance with an important feature of the present invention, reciprocating sharpener 10 includes four, thin, flat, steel springs 22, 24, 26 and 28 of equal rectangular configuration. One edge of each of the springs 22, 24, 26 and 28 is rigidly attached normal to the base member 18 by means of screw clamps 30, 31, 32 and 33 and identical fasteners 34.

In accordance with another important feature of the present invention, attached to the opposite edge of flat springs 22, 24, 26 and 28 by means of screw clamps 35, 37, 39 and 41 are two bridge members 36 and 38. The members 36 and 38 are designated hereinafter as work armatures 36 and 38 since they reciprocate in response to an electromagnetic field and may be attached to a work means such as an abrasive surface.

The work armatures 36 and 38 have mounted on the upper surface thereof abrasive or grinding surfaces 40 and 42, such as tungsten carbide grains. The work armatures 36 and 38 are in a parallel, coplanar configuration and disposed relative to the housing 12, and in particular sloped side portions 13, in a manner such that a workpiece may be positioned against the upper abrasive surfaces 40 and 42 of the work armatures 36 and 38 with a minimum of peripheral obstruction. It should be noted that the surfaces 40 and 42 may be formed with varying degrees of coarseness, such as by dividing each of the lengths of the surfaces into a first coarse grain length segment, a medium grain length segment and a fine grain length segment. However, the configuration and disposition of the surface 40 should be substantially identical to that of the surface 42 to thereby provide equal and opposite friction forces on a workpiece.

In keeping with the invention, a laminated, iron stator core 46 is securely mounted at the center of the base member 18 with the planes of the laminae normal to the direction of reciprocation. The stator core 46 in the illustrated embodiment may be of an "E" configuration having a center leg 47 which carries a field coil 48.

An additional important feature of the present invention comprises extensions 50 and 52 (FIG. 6) secured to the work armatures 36 and 38, respectively, by a fastener or, as depicted in the preferred embodiment, formed integrally therewith. Extensions 50 and 52 carry laminated, iron armature cores 54 and 56. The armature cores 54 and 56 are mounted on the extensions 50 and 52 to define a controlled air gap 58 (FIG. 3) between the upper surface of the stator core 46 and the lower surface of the armature cores 54 and 56. In addition, the iron armatures cores 54 and 56 are symmetrically disposed at the edges of the stator core 46 (FIG. 2). In order to prevent the armatures 36 and 38 from reciprocating with excessive amplitudes during periods of energization when the workpiece is removed from the abrasive work-surfaces, a resilient bumper 62 (FIG. 3) is mounted on the upper surface of the stator core 46 between the armature cores 54 and 56.

In accordance with another important feature of the present invention, the stator core 46 includes a plurality of planar, iron, core laminae 49 (FIG. 3) that are disposed substantially normal or perpendicular to the direction of the reciprocative path or motion of the work armatures 36 and 38. In addition, the armature cores 54 and 56 include a plurality of planar laminae 53 and 55, respectively, disposed generally normal or perpendicular to the direction of reciprocation.

When the field coil 48 is energized, magnetic flux is generated in the stator core 46. Due to the offset disposition of the armature cores 54 and 56 on either side of the stator core 49 and spaced from it by the controlled air gap 58, the strong magnetic flux generated in the stator core 46 moves the armature cores 54 and 56 equally toward the center of the stator core 49, equally deflecting the armature members 36 and 38 in opposite directions along the direction of reciprocation and storing energy in the four flat springs 22, 24, 26 and 28. When the field coil 48 is deenergized, the deflected springs cause the armature to move back in the opposite direction beyond the rest position because of the efficient energy storage capability of the substantially friction free spring-mass system defined by the rectangular parallelepiped configuration described in greater detail in the above-mentioned copending application. This rectangular parallelepiped configuration formed by the base, flat springs and armature provides only one degree of freedom that is normal to the planes of the flat springs and parallel to the base and that rigidly defines the direction of reciprocation.

The laminae of the stator core 46 and of the armature cores 54 and 56 are all disposed so that their planes are normal to the direction of reciprocation. This disposition of the laminae causes the transverse component of magnetic force between the armature cores 54 and 56 and stator core 46 to be more uniform and extend over a wide displacement. As described in the above-mentioned copending application, this improved force-displacement characteristic is due to the presence of oxide coatings on the surfaces of the iron core laminae. The oxide coatings are normally present in core laminations for the purpose of reducing eddy-current losses since they are poor conductors of electric current.

In the present invention, they serve an additional purpose. Since the coatings are also nonmagnetic, they therefore provide thin, nonmagnetic gaps between adjacent laminations to increase the reluctance of the magnetic flux paths normal to the planes of the laminae as compared to the flux paths through the same laminae parallel to the laminae. This desirable effect may be enhanced by increasing the non-magnetic spaces between the laminae by adding a coating of insulating varnish or other nonmagnetic material to the oxide coatings. Such a combination in practice may provide nonmagnetic spacings in the order of 20% of the thicknesses of the iron in the laminae to thereby provide a reluctance value normal to the laminae of the order of 1000 times the value of reluctance parallel to the laminae.

In operation, the field coil 48 may be connected to a periodic electric current as provided by half-wave rectified alternating current. The magnetic field generated in the laminae 49 of the stator 46 as a result of electric current in the coil 48, attracts the armature cores 54 and 56 in a direction towards each other and the center of stator 46. Once the coil 48 is deenergized on the alternate half-cycle, the magnetic field is dissipated releasing the armature cores 54 and 56. During this portion of the cycle, the work armatures 36 and 38 are under the influence of their respective deflected flat springs 22, 24, 26 and 28 resulting in movement opposite the previous movement and away from stator core 46. This cycle is repeated each time the field coil 48 is energized, causing armatures 36 and 38 to reciprocate in a parallel, coplanar fashion but 180 degrees out-of-phase. The deflection of the flat springs 22, 24, 26 and 28 and the work armatures 36 and 38 is best illustrated by the dotted lines shown in FIG. 3.

Since the reciprocating sharpener 10 does not require bearings or other surface engaging positioning means, grit or filings as a result of the interaction of the abrasive surfaces 40 and 41 attached to work armatures 36 and 38 with a workpiece do not have any deleterious effect on the working mechanism of the reciprocating sharpener 10.

The rectangular parallelepiped spring-mass configuration of the present invention is a very efficient energy-storage system because of the substantially friction free action of the spring-mass elements. The system therefore exhibits sharp mechanical resonance and is, in effect, a sharply tuned mechanical oscillator.

Considering only one of the armature spring-base elements at a time, the mechanical resonance of the system is expressed by the relationship:

$$n = \frac{1}{2\pi}\sqrt{K\,\frac{(M_1 + M_2)}{M_1 M_2}}$$

where:

$n$ = natural frequency of the system,

K = the combined spring rate, $M_1$ = total mass of armature, and $M_2$ = total mass of the base.

In the present invention, two substantially equal armature systems 36 and 38 are joined by means of equal spring sets 22, 26 and 24, 28 to the same base 18. Furthermore, the two equal systems are mounted close together on the same base in such a manner that their single degree of freedom is in the same direction and their centers of mass are nearly coincident. Finally, the position of the stator core 46 relative to the armature cores 54 and 56 cause the two equal systems to deflect equally in opposite directions. This results in reciprocation 180° out-of-phase, cancelling inertial forces to the base with equal masses as follows:

$$n = \frac{1}{2\pi}\sqrt{\frac{2K}{M_1}}$$

where:

$n$ = natural frequency of the system

K = combined spring rate (both armatures acting together), and $M_1$ = mass of one of the two equal armatures.

If K and $M_1$ are designed so that the natural frequency n is sixty cycles per second, the sharpener 10 will operate at resonance when the coil 48 is energized by a sixty cycle current source through a half-wave rectifier. This provides sixty pulses per second spaced apart by the excluded half-cycles.

Obviously, this sharpener 10 could be excited by other means; and, if a higher power capacity were required, the sharpener 10 may be driven by a full-wave reciprocating motor as disclosed in the above-mentioned copending application.

Since the work armatures 36 and 38 oscillate 180 degrees out-of-phase, the vibratory effects of the oscillating work armature 36 and 38 as transmitted to the base member 18 are cancelled, thereby subjecting the base member 18 to little or no vibration.

Obviously, many modifications and variations of the present invention are possible in light of the above teachings. Thus, it is to be understood that, within the scope of the appended claims, the invention may be practiced otherwise than as specifically described above.

What is claimed as new and desired to be secured by Letters Patent of the U.S. is:

1. A knife edge sharpener comprising means for simultaneously sharpening first and second spaced apart portions of the same side of the same knife edge, said sharpening means comprising a first elongated armature including a first work surface moveable along a first reciprocative path for sharpening said first portion of said knife edge, a second elongated armature including a second work surface moveable along a second reciprocative path for grinding or sharpening said second portion of said knife edge, said first path being parallel to and spaced apart from said second path, abrasive material affixed to both said first and said second work surfaces and means for moving said first and second armatures and said first and second work surfaces along said first and second paths substantially 180° out-of-phase with respect to each other.

2. A knife edge sharpener as defined in claim 1 wherein said sharpening means further comprises a rigid base member and a laminated stator core securely fixed to said base member.

3. A knife edge sharpener as defined in claim 2 wherein said laminated stator core includes a plurality of laminae disposed generally perpendicularly to said directions of said first and second paths.

4. A knife edge sharpener as defined in claim 3 wherein said sharpening means further comprises a first laminated armature core having a second plurality of laminae disposed generally perpendicularly to the direction of said first path, said first laminated armature core being securely fixed to said first elongated armature, and a second laminated armature core having a third plurality of laminae disposed generally perpendicularly to the direction of said second path, said second laminated armature core being securely fixed to said second elongated armature.

5. A knife edge sharpener as defined in claim 4 wherein said first and second armature cores each comprise substantially nonmagnetic means for spacing apart or physically separating adjacent laminae of said second and third pluralities of laminae to form substantially nonmagnetic gaps between said adjacent laminae.

6. A knife edge sharpener as defined in claim 5 wherein said adjacent laminae are planar laminae and wherein said nonmagnetic separating means comprises nonmagnetic coatings on both planar sides of each one of said planar laminae such that the total thickness of said coatings is approximately 20% of the thickness of each one of said planar laminae.

7. A knife edge sharpener as defined in claim 6 wherein the thicknesses of said nonmagnetic gaps between first portions of said second and third pluralities of laminae are substantially greater than the thicknesses of said nonmagnetic gaps between second portions of said second and third pluralities of laminae.

8. A knife edge sharpener as defined in claim 5 wherein the thicknesses of at least a portion of said nonmagnetic gaps are unequal and generally increase as the distances from their associated adjacent laminae increase from one end of each of said first and second armature cores.

9. A knife edge sharpener as defined in claim 2 wherein said sharpening means further comprises a plurality of elongated flat springs including at least first and second elongated flat springs each having one longitudinal end fixedly secured to said base member and the other longitudinal end fixedly attached to said first elongated armature and third and fourth elongated flat springs each having one longitudinal end fixedly secured to said base member and the other longitudinal end fixedly attached to said second elongated armature, said other ends of said first and second springs being respectively attached to opposite longitudinal ends of said first elongated armature and said other ends of said third and fourth springs being respectively attached to opposite longitudinal ends of said second elongated armature, the plane of said first spring being parallel to and spaced apart along the length of said first elongated armature from the plane of said second spring and the plane of said third spring being parallel to and spaced apart along the length of said second elongated armature from the plane of said fourth spring.

10. A knife edge sharpener as defined in claim 9 wherein said sharpening means further comprises a source of alternating current power and an exciter or field coil electrically connected to said power source for generating magnetic flux in said stator core upon excitation by said power source.

11. A knife edge sharpener as defined in claim 10 wherein said sharpening means further comprises a half-wave rectifier serially connected between said power source and said exciter coil to pass alternate half-cycles from said power source to said exciter coil.

12. A knife edge sharpener as defined in claim 1 wherein said first and second work surfaces are planar work surfaces, said moving means including means for maintaining the planes of said planar work surfaces coplanar during the entire operation of said device and wherein said first and second paths are substantially linear parallel paths.

13. A knife edge sharpener as defined in claim 12 wherein said sharpening means further comprises a housing for said first and second elongated armatures and said moving means, said housing including an elongated opening to provide access to at least elongated portions of said first and second work surfaces.

14. A knife edge sharpener as defined in claim 4 wherein the combined masses of said first mentioned elongated armature and of said first armature core are substantially equal to the combined masses of said second elongated armature and said second armature core.

15. A knife edge sharpener as defined in claim 14 wherein the movements of said first and second elongated armatures are oppositely directed and of equal amounts to thereby result in the cancellation of the vibrations transmitted to said rigid base member by the movements of said first and second elongated armatures.

16. A knife edge sharpener as defined in claim 4 wherein said first and second armature cores are spaced apart and positioned at opposite ends of said stator core, and upon the generation of magnetic flux in said stator core by the excitation of said exciter coil, urge said first and second elongated armatures to traverse equal distances in opposite directions along said first and second paths.

17. A knife edge sharpener comprising means for simultaneously sharpening first and second spaced apart portions of the same side of the same knife edge, said sharpening means comprising a first armature including a first moveable abrasive planar work surface for sharpening said first portion of said knife edge, and a second armature including a second moveable abrasive planar work surface for sharpening said second portion of said knife edge, and means for moving said first and second work surfaces, said moving means comprising means for maintaining the planes of said first and second work surfaces substantially coplanar during the entire operation of said device.

18. A knife edge sharpener as defined in claim 17 wherein said sharpening means further comprises a rigid base member and a laminated stator core securely fixed to said base member.

19. A knife edge sharpener as defined in claim 18 wherein said laminated stator core includes a plurality of laminae disposed generally perpendicular to said directions of movement of said first and second work surfaces.

20. A knife edge sharpener as defined in claim 19 wherein said sharpening means further comprises a first laminated armature core having a second plurality of laminae disposed generally perpendicularly to the direction of movement of said first work surface, said first laminated armature core being securely fixed to said first armature, and a second laminated armature core having a third plurality of laminae disposed generally perpendicularly to the direction of movement of said second work surface, said second laminated armature core being securely fixed to said second armature.

21. A knife edge sharpener as defined in claim 20 wherein both said first and second armature cores comprise substantially nonmagnetic means for spacing apart or physically separating adjacent laminae of said second and third pluralities of laminae to form substantially nonmagnetic gaps between said adjacent laminae.

22. A knife edge sharpener as defined in claim 21 wherein said adjacent laminae are planar laminae and wherein said nonmagnetic separating means comprises nonmagnetic coatings on both planar sides of each one of said planar laminae such that the total thickness of said coatings is approximately 20% of the thickness of each one of said planar laminae.

23. A knife edge sharpener as defined in claim 22 wherein the thicknesses of said nonmagnetic gaps between first portions of said second and third pluralities of laminae are substantially greater than the thicknesses of said nonmagnetic gaps between second portions of said second and third pluralities of laminae.

24. A knife edge sharpener as defined in claim 21 wherein the thicknesses of at least a portion of said nonmagnetic gaps are unequal and generally increase as the distances from their associated adjacent laminae increase from one end of each of said first and second armature cores.

25. A knife edge sharpener as defined in claim 18 wherein said sharpening means further comprises a plurality of elongated flat springs including at least first and second elongated flat springs each having one longitudinal end fixedly secured to said base member and the other longitudinal end fixedly attached to said first armature and third and fourth elongated flat springs each having one longitudinal end fixedly secured to said base member and the other longitudinal end fixedly attached to said second armature, said other ends of said first and second springs being respectively attached to opposite longitudinal ends of said first armature and said other ends of said third and fourth springs being respectively attached to opposite longitudinal ends of said second armature, the plane of said first spring being parallel to and spaced apart along the length of said first armature from the plane of said second spring and the plane of said third spring being parallel to and spaced apart along the length of said second armature from the plane of said fourth spring.

26. A knife edge sharpener as defined in claim 25 wherein said sharpening means further comprises a source of alternating current power and an exciter or field coil electrically connected to said power source for generating magnetic flux in said stator core upon excitation by said power source.

27. A knife edge sharpener as defined in claim 26 wherein said sharpening means further comprises a half-wave rectifier serially connected between said power source and said exciter coil.

28. A knife edge sharpener as defined in claim 17 wherein said first and second work surfaces are moveable along substantially linear, parallel paths.

29. A knife edge sharpener as defined in claim 28 wherein said sharpening means further comprises a housing for said first and second armatures and said moving means, said first and second armatures comprising elongated members, said housing including an elongated opening to provide access to at least the elongated portions of said first and second work surfaces.

30. A knife edge sharpener as defined in claim 20 wherein the combined masses of said first mentioned armature and of said first armature core are substantially equal to the combined masses of said second armature and said second armature core.

31. A knife edge sharpener as defined in claim 28 wherein the movements of said first and second armatures are oppositely directed and of equal amounts to thereby result in the cancellation of the vibrations transmitted to said rigid base member by the movements of said first and second armatures.

32. A knife edge sharpener as defined in claim 20 wherein said first and second armature cores are spaced apart and positioned at opposite ends of said stator core and, upon the generation of magnetic flux in said stator core by the excitation of said exciter coil, urge said first and second elongated armatures to traverse equal distances in opposite directions along said first and second paths.

33. A grinding or sharpening device comprising an armature moveable along a reciprocative path, said armature including a work surface, an abrasive material affixed to said work surface, a stator core having an electrically generated magnetic field, and a laminated armature core fixedly secured to said armature and having a plurality of laminae disposed generally perpendicularly to the direction of said reciprocative path, said armature core being physically disposed externally to and spaced apart from said stator core over said entire reciprocative path and being positioned substantially completely out of the magnetic field of said tive path and substantially completely within the magnetic field of said stator core at the other end of said reciprocative path, said plurality of laminae being substantially nonsaturated by said magnetic field at said one end of said reciprocative path and being serially saturated by said magnetic field as said armature core approaches said other end of said reciprocative path and being substantially completely saturated by said magnetic field at said other end of said reciprocative path.

34. A grinding or sharpening device as defined in claim 33 wherein said laminated armature core comprises nonmagnetic means for physically separating adjacent laminae of said plurality of laminae to thereby form non-magnetic gaps between said adjacent laminae.

35. A grinding or sharpening device as defined in claim 33 further comprising a rigid base member and wherein said stator core further comprises a laminated stator core having a second plurality of laminae disposed generally perpendicularly to said direction of said reciprocative path, said stator core being fixedly secured to said base member.

36. A grinding or sharpening device as defined in claim 35 further comprising a plurality of substantially identical, thin, flat springs including at least first and second thin, flat springs each having one edge fixedly secured to said base member and each having an opposite edge fixedly secured to said armature to form a rectangular parallelepiped configuration in an at-rest condition.

37. A grinding or sharpening device as defined in claim 36 further comprising a second armature moveable along a second reciprocative path, said second armature including a second work surface, the planes of said first mentioned work surface and said second work surface being maintained substantially coplanar during the reciprocative movements of said first mentioned armature and said second armature, an abrasive material affixed to said second work surface, and a second laminated armature core fixedly secured to said second armature and having a third plurality of laminae disposed generally parallel to said first mentioned plurality of laminae.

38. A grinding or sharpening device as defined in claim 37 wherein said plurality of flat springs further includes third and fourth thin, flat springs each having one edge fixedly secured to said base member and an opposite edge fixedly attached to said second armature to form a rectangular parallelepiped configuration in an at-rest condition.

39. A grinding or sharpening device as defined in claim 38 wherein the mass of said first armature substantially equals the mass of said second armature.

40. A grinding or sharpening device as defined in claim 39 wherein the movements of said first and second armatures are oppositely directed.

* * * * *

UNITED STATES PATENT OFFICE

CERTIFICATE OF CORRECTION

Patent No. 3,956,856 Dated May 18, 1976

Inventor(s) Edward H. Yonkers

It is certified that error appears in the above-identified patent and that said Letters Patent are hereby corrected as shown below:

Claim 19, column 8, line 38, change "perpendicular" to --perpendicularly--; and
Claim 33, column 10, line 17, after "said" insert --magnetic stator core at one end of said reciproca- --.

Signed and Sealed this

Twelfth Day of October 1976

[SEAL]

*Attest:*

RUTH C. MASON
*Attesting Officer*

C. MARSHALL DANN
*Commissioner of Patents and Trademarks*